US009829252B2

(12) United States Patent
Holmes et al.

(10) Patent No.: US 9,829,252 B2
(45) Date of Patent: Nov. 28, 2017

(54) TANK FOR HEAT EXCHANGER

(71) Applicant: DENSO International America, Inc., Southfield, MI (US)

(72) Inventors: Mark Holmes, Troy, MI (US); Daniel Tylutki, Livonia, MI (US)

(73) Assignee: DENSO International America, Inc., Southfield, MI (US)

( * ) Notice: Subject to any disclaimer, the term of this patent is extended or adjusted under 35 U.S.C. 154(b) by 950 days.

(21) Appl. No.: 14/045,862

(22) Filed: Oct. 4, 2013

(65) Prior Publication Data

US 2015/0096725 A1 Apr. 9, 2015

(51) Int. Cl.
*F28F 9/02* (2006.01)
*F28D 1/053* (2006.01)

(52) U.S. Cl.
CPC ..... *F28D 1/05366* (2013.01); *F28F 9/0226* (2013.01); *F28F 2275/122* (2013.01)

(58) Field of Classification Search
CPC .... F28F 9/00; F28F 9/02; F28F 9/0248; F28F 9/04; F28F 3/12; F28F 3/14; F28F 9/0226; F28F 2275/122; F28D 1/05316; F28D 1/00; F28D 1/05366
USPC .... 165/148, 149, 157, 158, 1, 153, 168, 170
See application file for complete search history.

(56) References Cited

U.S. PATENT DOCUMENTS 4,289,507 A * 9/1981 Cadars ..... F01P 11/02 165/104.32
4,461,348 A * 7/1984 Toge ..... F28F 9/0226 165/149
4,649,628 A * 3/1987 Allemandou ..... F28F 9/0226 165/148
4,997,035 A * 3/1991 Beatenbough ..... F28F 9/0226 165/149
5,195,581 A * 3/1993 Puntambekar ..... F28F 9/0226 156/91
5,195,582 A * 3/1993 Haase ..... F28F 9/0226 165/149
5,355,944 A * 10/1994 Potier ..... F28D 1/053 165/149
5,758,721 A * 6/1998 Letrange ..... F28F 9/0226 165/149
7,255,158 B2 * 8/2007 Ozaki ..... F28D 1/05366 165/149

(Continued)

FOREIGN PATENT DOCUMENTS

DE 3222300 A1 * 12/1983 ..... F28F 9/0226

OTHER PUBLICATIONS

DE-3222300 Machine Translation.*

*Primary Examiner* — Len Tran
*Assistant Examiner* — Gustavo Hincapie Serna

(57) ABSTRACT

A tank for a heat exchanger includes a tank member and a base member. The tank member has one of a pre-crimped tab and a slot portion on a first lateral side. The pre-crimped tab is bent outward from a longitudinal axis. The slot portion has a throughhole. The base member has the other of the pre-crimped tab and the slot portion on the first lateral side. The tank member and the base member are fitted together to define an inner cavity therebetween. The pre-crimped tab is inserted in the throughhole on the first lateral side. One of the tank member and the base member is crimped to the other of the tank member and the base member on a second lateral side.

16 Claims, 10 Drawing Sheets

(56) References Cited

U.S. PATENT DOCUMENTS

| | | | | |
|---|---|---|---|---|
| 7,341,098 | B2 * | 3/2008 | Brost | F28D 1/05366 165/149 |
| 7,640,971 | B2 * | 1/2010 | Kolb | B21D 53/08 165/149 |
| 8,181,694 | B2 * | 5/2012 | Powers | F28F 9/0226 165/149 |
| 2006/0113069 | A1 * | 6/2006 | Ninagawa | F28F 9/0224 165/149 |
| 2008/0047687 | A1 | 2/2008 | Leitch et al. | |
| 2008/0135220 | A1 * | 6/2008 | Aksoy | F28F 9/0224 165/157 |
| 2009/0126517 | A1 * | 5/2009 | Lorentz | G01M 3/04 73/865.8 |
| 2010/0300664 | A1 * | 12/2010 | Kang | F28D 1/05383 165/157 |

* cited by examiner

TANK FOR HEAT EXCHANGER

TECHNICAL FIELD

The present disclosure relates to a tank for a heat exchanger.

BACKGROUND

A known heat exchanger, such as a radiator, has a radiator core including tubes and fins, which are alternately stacked in its vertical direction. Such a radiator core is interposed between side tanks in its lateral direction. Such a side tank includes a tank member and a base member, which are assembled together to define an inner cavity to flow a thermal medium therethrough. Conventionally, such a tank member and a base member are crimped together at both lateral peripheries by applying force using a crimping apparatus, such as a die and/or a roller. In such a conventional side tank, large working spaces are needed around both the lateral peripheries of the tank to place the crimping apparatus on each of the lateral peripheries of the tank. In addition, complicated manufacturing process is required to crimp both the lateral peripheries of a conventional side tank.

SUMMARY

The present disclosure addresses the above-described concerns.

According to an aspect of the present disclosure, a tank for a heat exchanger, the tank comprises a tank member having a first slot portion on a first lateral side. The first slot portion defines a first throughhole. The tank further comprises a base member having a pre-crimped tab on the first lateral side. The pre-crimped tab is bent outward from a longitudinal axis. The tank member and the base member are fitted together to define an inner cavity therebetween. The pre-crimped tab is inserted in the first throughhole on the first lateral side. The base member is crimped to the tank member on a second lateral side.

According to another aspect of the present disclosure, a tank for a heat exchanger, the tank comprises a tank member. The tank further comprises a base member having a pre-crimped portion on a first lateral side. The tank member and the base member are fitted together to define an inner cavity therebetween, by inserting a lateral end of the tank member inside the pre-crimped portion, and rotating the tank member relative to the base member along the pre-crimped portion. The base member is crimped to the tank member on a second lateral side.

According to another aspect of the present disclosure, a tank for a heat exchanger, the tank comprises a tank member having one of a pre-crimped tab and a first slot portion on a first lateral side, the pre-crimped tab being bent outward from a longitudinal axis, the first slot portion having a first throughhole. The tank further comprises a base member having an other of the pre-crimped tab and the first slot portion on the first lateral side. The tank member and the base member are fitted together to define an inner cavity therebetween. The pre-crimped tab is inserted in the first throughhole on the first lateral side. One of the tank member and the base member is crimped to an other of the tank member and the base member on a second lateral side.

According to another aspect of the present disclosure, a tank for a heat exchanger, the tank comprises a tank member. The tank further comprises a base member. One of the tank member and the base member has a pre-crimped portion on a first lateral side. The tank member and the base member are fitted together to define an inner cavity therebetween, by inserting a lateral end of an other of the tank member and the base member inside the pre-crimped portion, and rotating one of the tank member and the base member relative to an other of the tank member and the base member along the pre-crimped portion. One of the tank member and the base member is crimped to an other of the tank member and the base member on a second lateral side.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

First Embodiment

As follows, a first embodiment of the present disclosure will be described with reference to FIGS. 1 to 3D.

Figure 1:
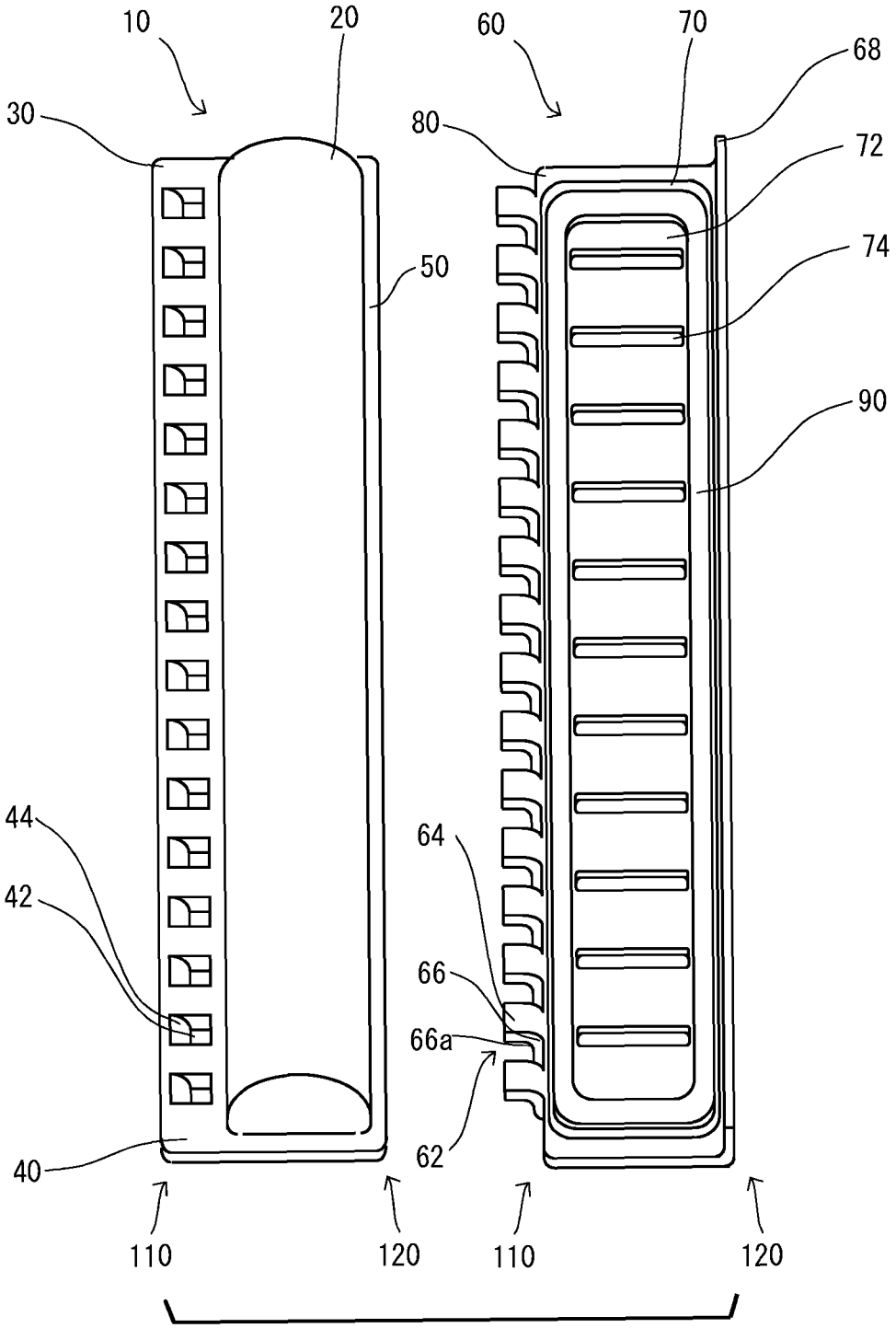
FIG. 1 is a perspective view showing a tank member and a base member of a tank according to a first embodiment.
Figure 2:
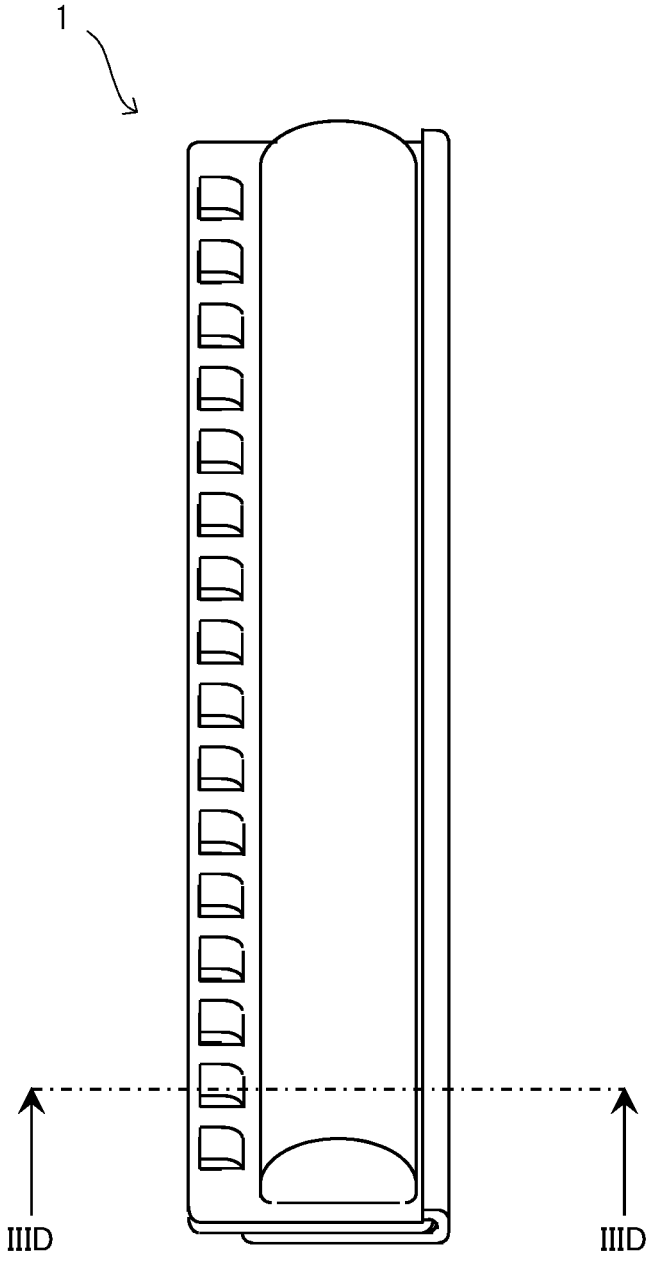
FIG. 2 is a perspective view showing the tank constructed of the tank member and the base member according to the first embodiment.

FIG. 1 shows a tank member 10 and a base member 60, which are assembled together to construct the tank 1 shown in FIG. 2. Referring back to FIG. 1, the tank member 10 is formed of a metallic material such as an aluminum alloy by die-casting or press working.

The tank member 10 has a tank-main portion 20 and a tank-plate portion 30. The tank-main portion 20 is hollow and has a semi-circular cross section relative to its longitudinal axis.

The base member 60 is formed of a metallic material such as an aluminum alloy by die-casting or press working. The base member 60 has a base-main portion 70 and a base-plate portion 80. The base-main portion 70 has a U-shape cross section relative to its longitudinal axis.

The base-main portion 70 has a bottom portion 72 dented from the base-plate portion 80. The bottom portion 72 has multiple openings 74, which may be formed by machining or press-working such as punching. Each of the openings 74 is in a chamfered rectangular shape and is configured to be connected with a tube 2 of a heat exchanger 500, which will be described later with reference to FIG. 4. The bottom portion 72 has a bottom surface adhered with a seal member 90. The seal member 90 is in a planar O-shape having a center opening. The bottom portion 72 internally defines a cavity, which communicates with the openings 74 through the center opening of the seal member 90. The seal member 90 is an elastic member formed of an elastomer such as a rubber.

In the present embodiment, the tank member 10 has a slot portion 40 on a first lateral side 110 of the tank-plate portion 30. The slot portion 40 has throughholes 42. Each of the throughholes 42 extends through the slot portion 40 in a thickness-direction of the slot portion 40. The slot portion 40 has curved slopes 44 each adjacent to corresponding one of the throughholes 42. The curved slope 44 is located on an outside from the longitudinal axis of the tank member 10 across the throughhole 42. The throughholes 42 and the curved slopes 44 may be formed by machining and/or press-working such as punching.

The base member 60 includes pre-crimped tabs 62 located on the first lateral side 110 of the base-plate portion 80. The number of the pre-crimped tabs 62 of the base member 60 may be same as the number of the throughholes 42 of the tank member 10. Each of the pre-crimped tabs 62 includes a tab end 64 and a bent portion 66. The tab end 64 extends outward from the bent portion 66 relative to the longitudinal axis of the base member 60. The bent portion 66 is raised from the base-plate portion 80 in a thickness direction of the base-plate portion 80. The bent portion 66 is bent outward relative to the longitudinal axis to define a bent curved surface 66*a*. The bent curved surface 66*a* has a predetermined curvature, which is substantially identical to a curvature of the curved slope 44 of the slot portion 40. Therefore, the bent curved surface 66*a* may be configured to be fitted liquid-tightly to the curved slope 44. The pre-crimped tabs 62 may be formed by machining and/or press-working such as bending. The base member 60 includes a raised portion 68 on a second lateral side 120. The raised portion 68 is raised from the base-plate portion 80 in the thickness direction of the base-plate portion 80.

Figure 3A:
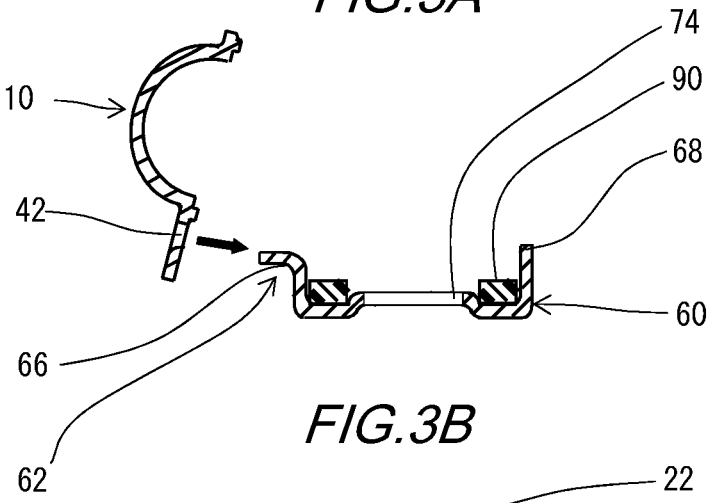
FIGS. 3A to 3D are sectional views showing a manufacturing process for the tank according to the first embodiment.

As follows, a manufacturing process to assemble the tank member 10 with the base member 60 will be described with reference to FIGS. 3A to 3D. FIG. 3A shows a state where the tank member 10 is to be engaged with the base member 60. In the present state, the positions of the pre-crimped tabs 62 of the base member 60 are set to meet the positions of the throughholes 42, respectively. Thus, the pre-crimped tabs 62 of the base member 60 are inserted into the throughholes 42, respectively to be in a state shown in FIG. 3B.

Figure 3B:
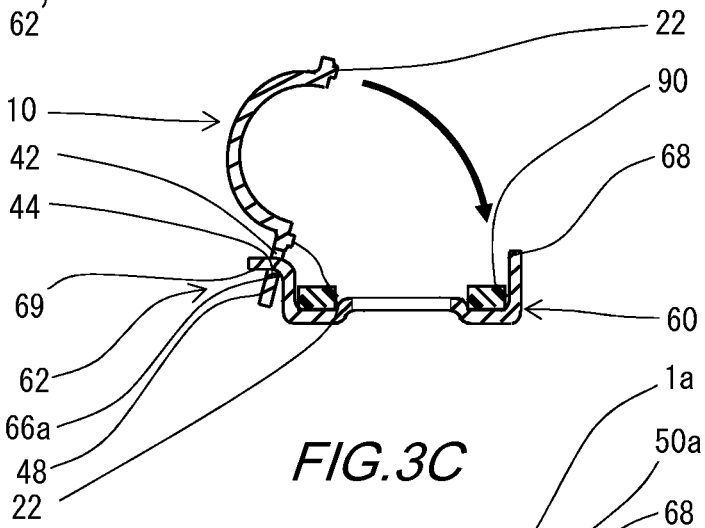

In the state of FIG. 3B, the base member 60 is engaged with the tank member 10 via the pre-crimped tabs 62 and the throughholes 42. In the present state, the pre-crimped tabs 62 are hinged, i.e., pivoted along the curved slopes 44, respectively.

Further, the tank member 10 is rotated relative to the base member 60 around the pre-crimped tabs 62, which are inserted into the throughholes 42. In the present state, the bent curved surface 66*a* of the bent portion 66 is slid along the curved slope 44 to guide the rotation of the tank member 10 relative to the base member 60. Further, in the present rotation, a rib 22 formed on a bottom surface of the tank member 10 is also rotated to be faced to the seal member 90, which is adhered to the base member 60. The rib 22 is substantially in an O-shape corresponding to the O-shape of the seal member 90. In addition, a contact surface 48 of the tank-plate portion 30 makes contact with a contact surface 69 of the pre-crimped tab 62. Thus, the tank member 10 and the base member 60 are fitted together to be in a state shown in FIG. 3C.

Figure 3C:
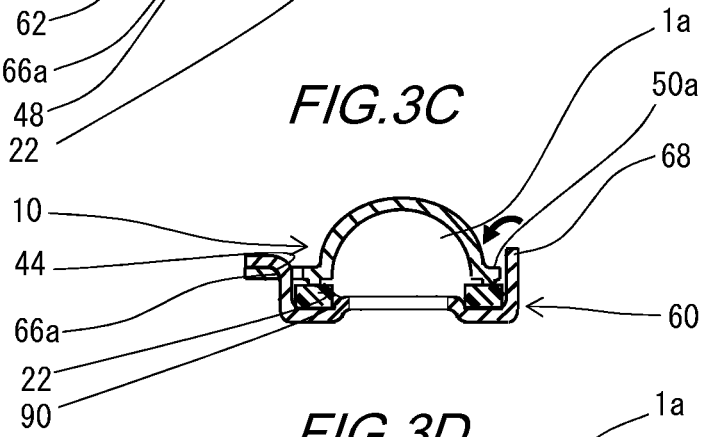

In the state of FIG. 3C, the tank member 10 is fitted to the base member 60. In the present state, the contact surface 48 (FIG. 3B) of the tank member 10 is in contact with the contact surface 69 (FIG. 3B) of the base member 60. The bent curved surface 66*a* of the base member 60 is resiliently in contact with the curved slope 44 of the tank member 10 to bias the tank member 10 toward the base member 60. In addition, the bent curved surface 66*a* may be in contact liquid-tightly with the curved slope 44. The rib 22 of the tank member 10 is urged onto the seal member 90 adhered to the base member 60 to form a liquid-tight sealed structure therebetween and to form a sealed inner cavity 1*a* between the tank member 10 and the base member 60. In the present state, the raised portion 68 of the base-plate portion 80 is bent inward to the longitudinal axis and crimped to a crimped surface 50*a* of the tank-plate portion 30. In the present crimping, the tank member 10 is further urged toward the base member 60. Thus, the contact surface 48 (FIG. 3B) of the tank member 10 is further urged onto the contact surface 69 (FIG. 3B) of the base member 60. In addition, the curved slope 44 of the tank member 10 may be further urged onto the bent curved surface 66*a* of the base member 60 to enhance the liquid-tight contact structure therebetween. Furthermore, the rib 22 of the tank member 10 is further urged onto the seal member 90 of the base member 60 to secure the liquid-tight sealed structure. In the present state, the rib 22 (FIG. 3B) is urged onto the seal member 90 to cause compression of the seal member 90 to form the liquid-tight seal between the tank member 10 and the base member 60. The rib 22 is urged onto the seal member 90 to cause elastic deformation of the seal member 90, thereby to cause reactive force to couple the tank member 10 with the base member 60 further securely.

Figure 3D:
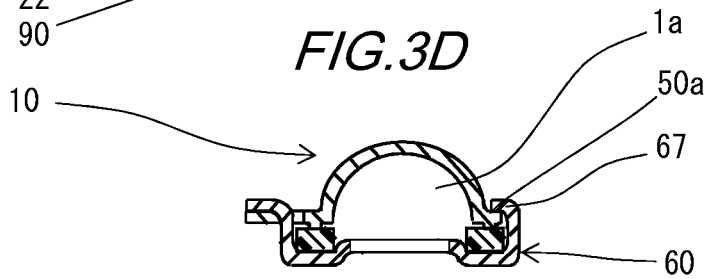

FIG. 3D is a sectional view taken along the line IIID-IIID in FIG. 2. As shown in FIG. 3D, the raised portion 68 (FIG. 3C) of the base member 60 is crimped onto the crimped surface 50*a* to be a crimped portion 67.

The present crimping may be implemented by pressing the raised portion 68 by using a bending die or by using a bending roller. The bending roller may roll around its center and may move along the raised portion 68 to bend the raised portion 68. In the present state of FIG. 3D, the tank member 10 and the base member 60 are securely coupled together.

Figure 4:
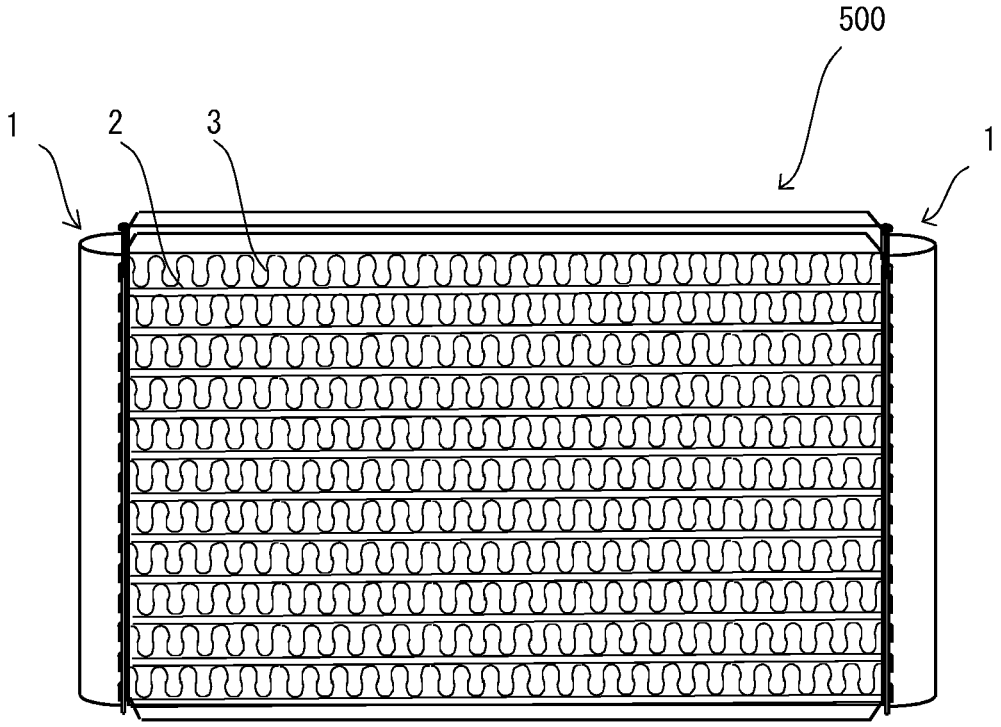
FIG. 4 is a perspective view showing a heat exchanger including the tank according to the first embodiment.

As shown in FIG. 4, two of the tanks 1 constructed as described above are further assembled with the tubes 2 and fins 3 to construct the heat exchanger 500. In the present configuration, the tubes 2 are coupled to the openings 74 of the base member 60, respectively, to be communicated with the inner cavity 1*a* of each tank 1. Thus, the present configuration forms multiple passages to communicate a thermal medium between inner passages of the tubes 2 with the inner cavity 1*a* of each tank 1. The constructed heat exchanger 500 may be brazed and integrated together.

The number of pre-crimped tab(s) 62 may be one and may be two or more. The number of the throughhole(s) 42 may be one and may be two or more, correspondingly to the number of the pre-crimped tab(s) 62.

According to the present embodiment, the tank member 10 has the slot portion 40 on the first lateral side 110. The base member 60 has the pre-crimped tab 62 on the first lateral side 110. The pre-crimped tab 62 is bent outward from the longitudinal axis. The slot portion 40 has the throughhole 42. The tank member 10 and the base member 60 are fitted together to define the inner cavity 1 a therebetween. The pre-crimped tab 62 is inserted in the throughhole 42 on the first lateral side 110. The base member 60 is crimped to the crimped periphery 50 of the tank member 10 on the second lateral side 120.

In the present configuration, the pre-crimped tab 62 is inserted in the throughhole 42 on the first lateral side 110, thereby to engage the base member 60 with the tank member 10 on the first lateral side 110. Therefore, the tank member 10 and the base member 60 need not be crimped on the first lateral side 110. Thus, no working space for a crimping apparatus is needed on the first lateral side 110 in the manufacturing process of the tank 1, thereby to reduce a manufacturing space for the tank 1 within a limited area. In addition, the tank member 10 and the base member 60 can be engaged together by inserting the pre-crimped tab 62 into the throughhole 42. Therefore, crimping is not needed on the first lateral side 110. Thus, manufacturing process of the tank 1 can be facilitated.

The base member 60 has the crimped portion 67 on the second lateral side 120. The crimped portion 67 is bent inward to the longitudinal axis and crimped to the tank member 10 on the second lateral side 120. In the present configuration, the tank member 10 and the base member 60 can be secured to each other on the second lateral side 120.

The tank member 10 and the base member 60 are fitted together by inserting the pre-crimped tab 62 into the throughhole 42, thereafter, by rotating the tank member 10 around the pre-crimped tab 62, which is inserted into and hinged along the throughhole 42, relative to the base member 60 to fit the contact surfaces 48, 69 of the tank member 10 and the base member 60 together. In the present configuration, the tank member 10 and the base member 60 can be easily assembled to each other and securely fitted to each other.

The slot portion 40 has the curved slope 44, which is adjacent to the throughhole 42 and located on the outside from the longitudinal axis across the throughhole 42. The pre-crimped tab 62 includes the tab end 64 and the bent portion 66. The tab end 64 extends outward from the bent portion 66 relative to the longitudinal axis. The bent portion 66 is bent outward relative to the longitudinal axis to define the bent curved surface 66*a*. The bent curved surface 66*a* is curved substantially along the curved slope 44 and is at least partially in contact with the curved slope 44. In the present configuration, the tank member 10 and the base member 60 can be guided by the bent curved surface 66*a* and the curved slope 44 when being rotted to each other. In addition, the bent curved surface 66*a* and the curved slope 44 can be fitted together to produce a sealing property therebetween.

The pre-crimped tab 62 is resiliently in contact with the curved slope 44 to bias the tank member 10 toward the base member 60. In the present configuration, the tank member 10 and the base member 60 can be securely fitted to each other.

The bottom portion 72 is equipped with the seal member 90 being elastic and substantially in an O-shape. The tank member 10 has the rib 22 substantially in an O-shape and urged onto the seal member 90. In the present configuration, the inner cavity 1 a defined between the tank member 10 and the base member 60 can be sealed from the outside of the tank 1.

The base member 60 has the bottom portion 72 having the openings 74 each extending through the bottom portion 72 in the thickness direction of the bottom portion 72. The openings 74 may be equipped with the tubes 2, respectively, to form passages to conduct a thermal medium therethrough.

Second Embodiment

Figure 5:
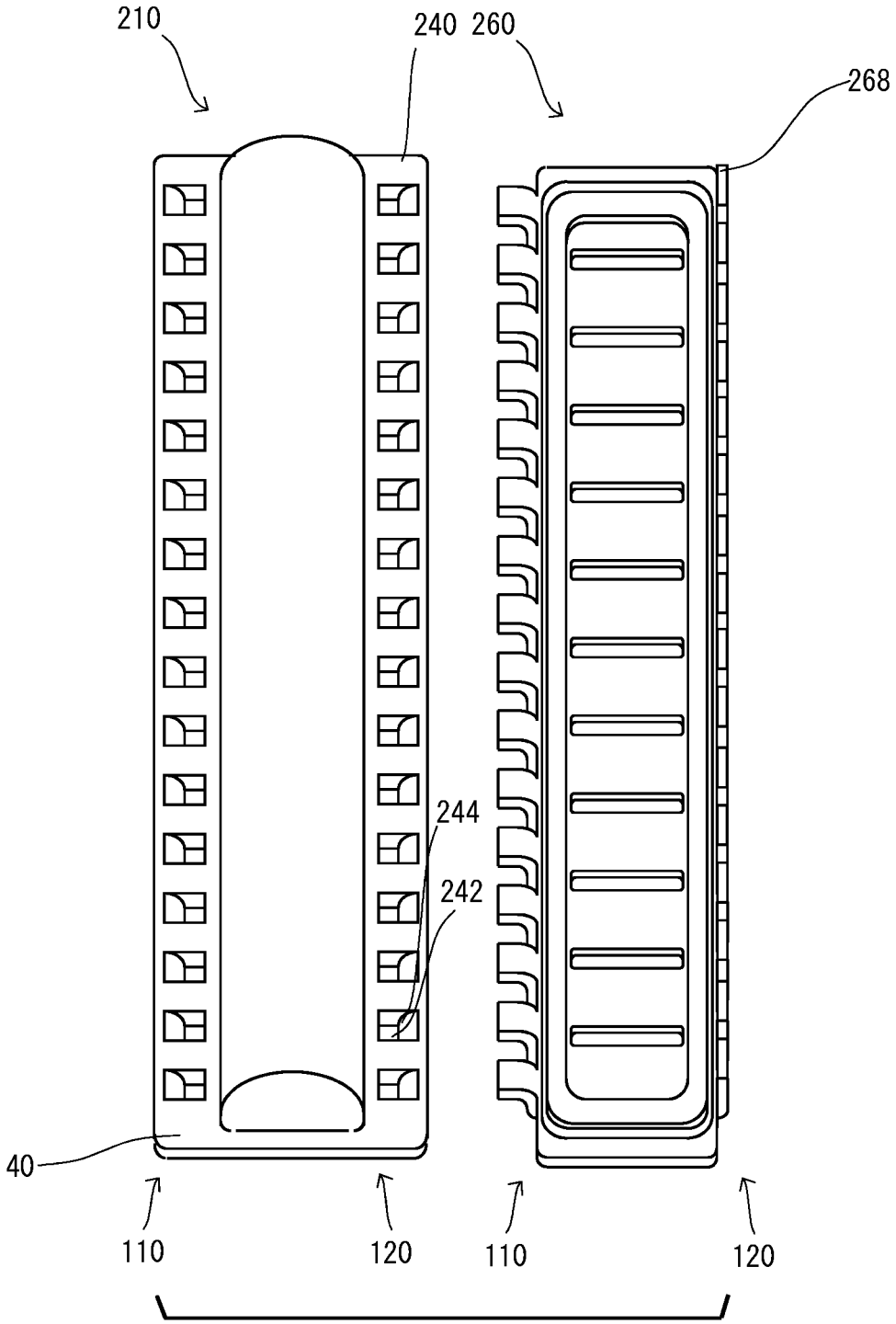
FIG. 5 is a perspective view showing a tank member and a base member of a tank according to a second embodiment.
Figure 6:
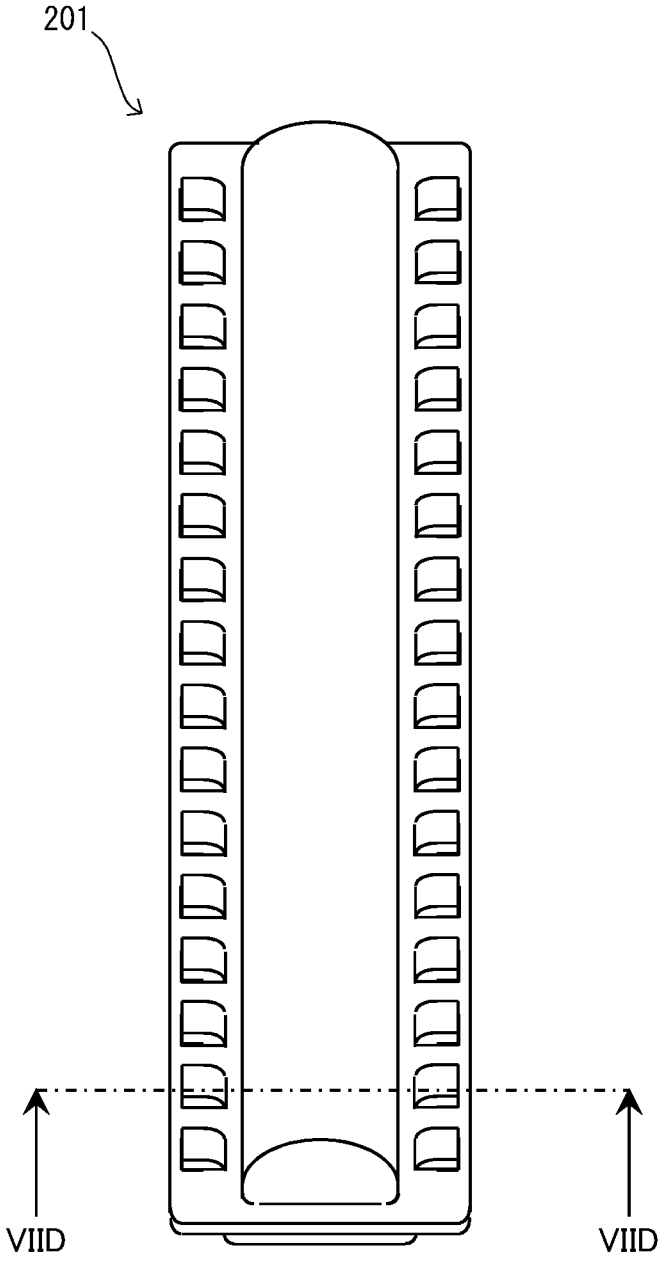
FIG. 6 is a perspective view showing the tank constructed of the tank member and the base member according to the second embodiment.

As follows, a tank 201 according to the second embodiment will be described with reference to FIGS. 5 to 7D. As shown in FIG. 5, a tank member 210 of the second embodiment has, in place of the crimped periphery 50 of the first embodiment, a slot portion 240 on the second lateral side 120. The slot portion 240 has throughholes 242 and curved slopes 244, similarly to the slot portion 40 on the first lateral side 110. A base member 260 of the second embodiment has, in place of the raised portion 68 of the first embodiment, raised tabs 268 on the second lateral side 120. The tank member 210 and the base member 260 shown in FIG. 5 are assembled together to construct the tank 201 of the second embodiment, as shown in FIG. 6.

Figure 7A:
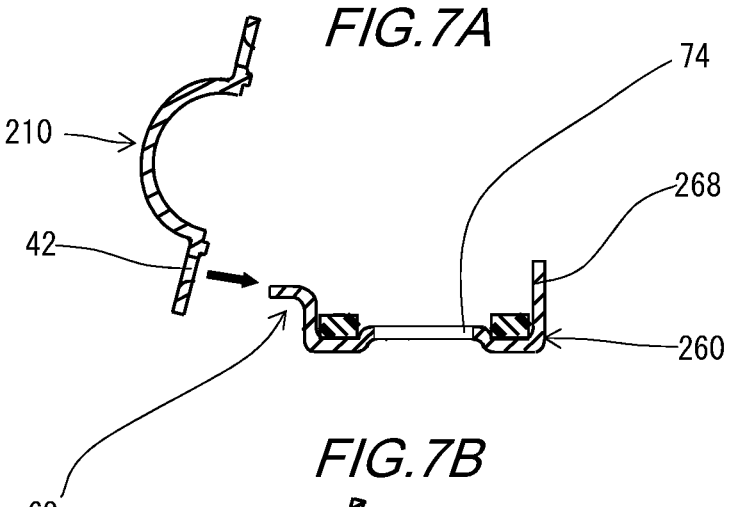
FIGS. 7A to 7D are sectional views showing a manufacturing process for the tank according to the second embodiment.
Figure 7B:
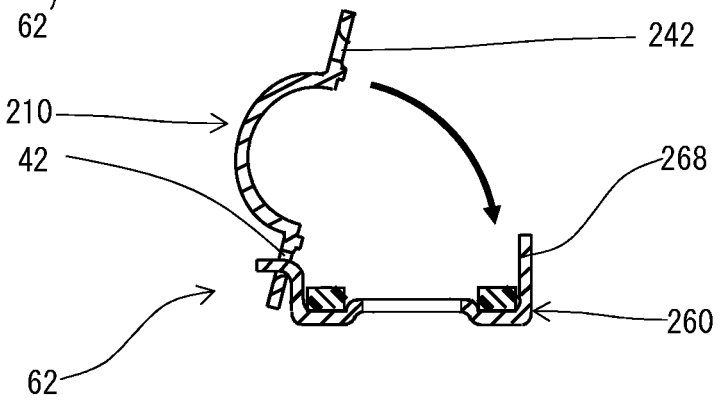
Figure 7C:
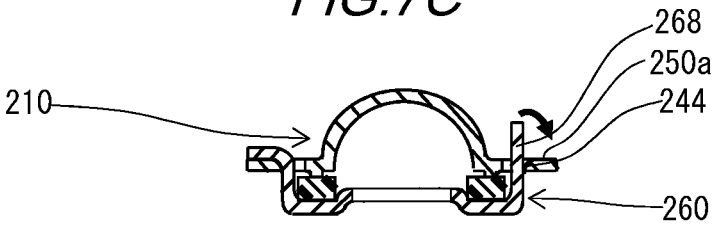
Figure 7D:
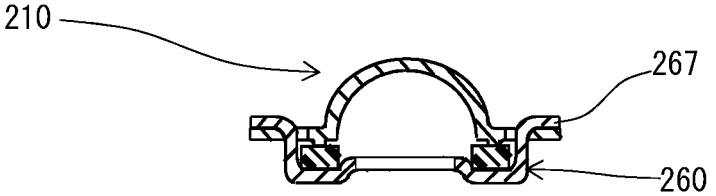

As follows, a manufacturing process to assemble the tank member 210 with the base member 260 of the second embodiment will be described with reference to FIGS. 7A to 7D. As shown in FIG. 7A, the pre-crimped tabs 62 of the base member 260 are positioned relative to the throughholes 42 of the tank member 210, respectively, and inserted into the throughholes 42, respectively to be in a state shown in FIG. 7B. In the state of FIG. 7B, the tank member 210 is rotated relative to the base member 260 around the pre-crimped tabs 62, which are inserted into the throughholes 42, respectively, similarly to the first embodiment. Thus, the raised tabs 268 are inserted into the though holes 242, respectively, and the tank member 210 and the base member 260 are fitted together to be in a state shown in FIG. 7C. In the state of FIG. 7C, the raised tabs 268 of the base-plate portion 80 are bent outward from the longitudinal axis along the curved slopes 244, respectively, and crimped to a crimped surface 250*a* of the tank member 210 to form crimped tabs 267 shown in FIG. 7D. FIG. 7D is a sectional view taken along the line VII-VII in FIG. 6.

The number of the crimped tab(s) 267 may be one and may be two or more, and the number of the throughhole(s) 242 may be one and may be two or more, correspondingly to the number of the crimped tab(s) 267.

In the constructed tank 201 according to the second embodiment, the base member 260 has the crimped tab 267 on the second lateral side 120. The tank member 210 has the slot portion 240 on the second lateral side 120. The slot portion 240 has the throughhole 242. The crimped tab 267 is inserted in the throughhole 242, bent outward from the longitudinal axis, and crimped to the tank member 210 on the second lateral side 120. In the present configuration, similarly to the first embodiment, the tank member 210 and the base member 260 need not be crimped on the first lateral side 110.

Third Embodiment

Figure 8:
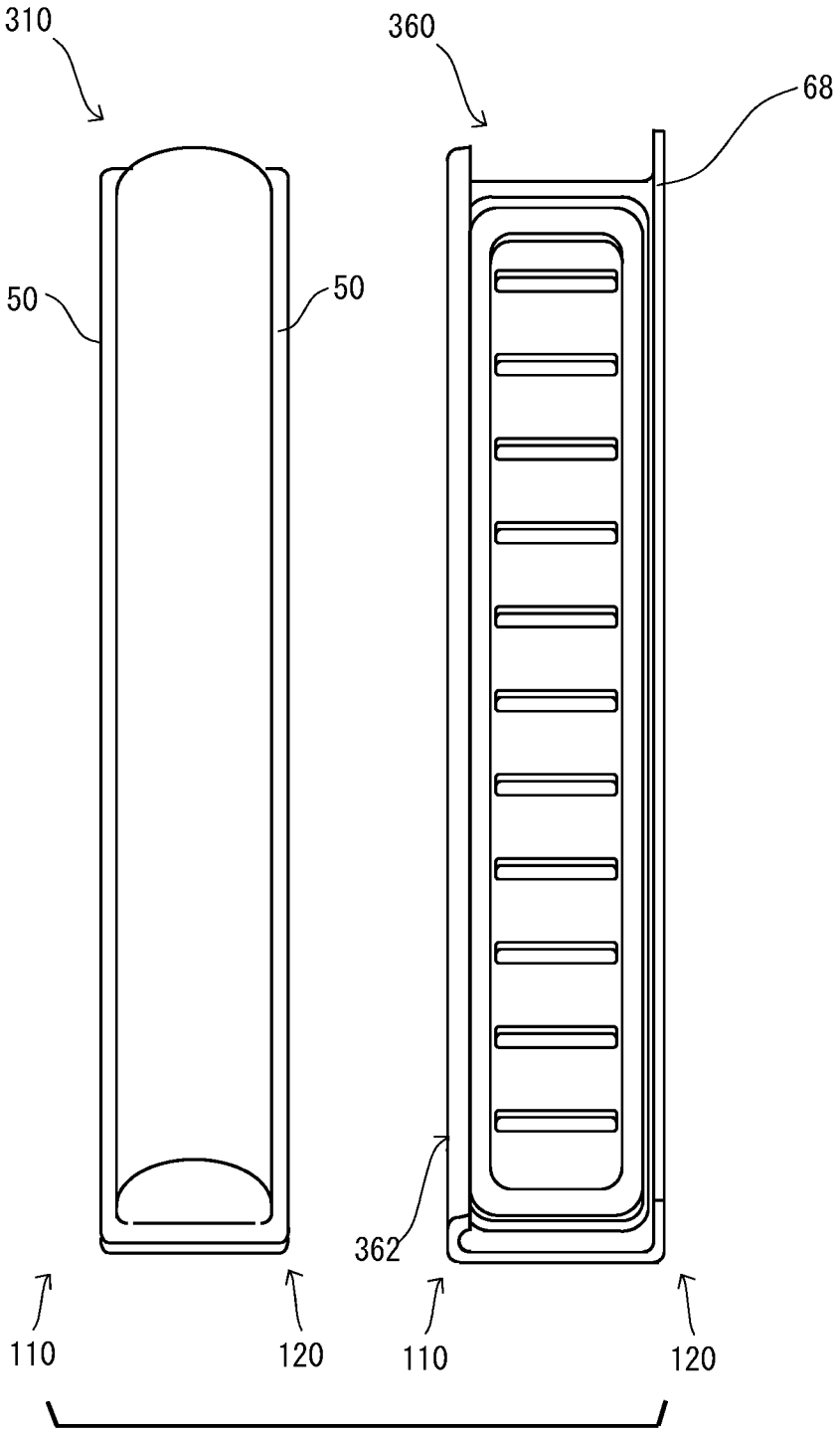
FIG. 8 is a perspective view showing a tank member and a base member of a tank according to a third embodiment.

As follows, a tank 301 according to a third embodiment will be described with reference to FIGS. 8 to 10D. As shown in FIG. 8, a tank member 310 of the third embodiment has the crimped periphery 50 on both sides. That is, the tank member 310 of the third embodiment does not have the slot portion 40 on the first lateral side 110, dissimilarly to the first and second embodiments.

Figure 9:
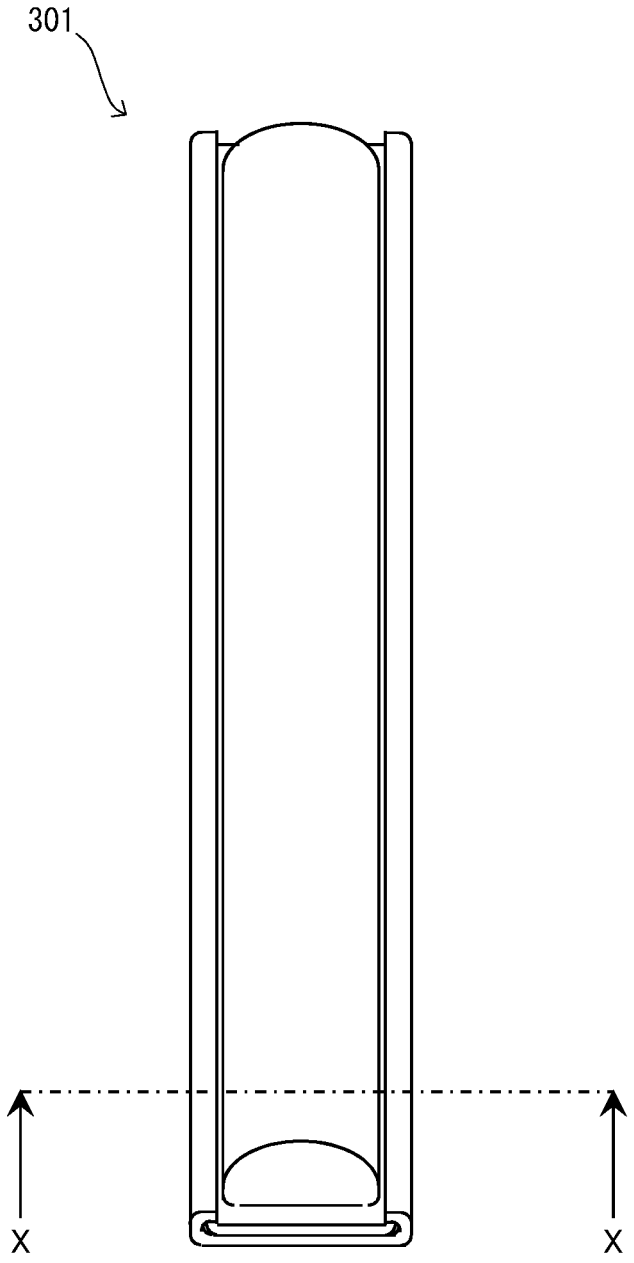
FIG. 9 is a perspective view showing the tank constructed of the tank member and the base member according to the third embodiment.

A base member 360 of the third member has a pre-crimped portion 362 on the first lateral side 110, in place of the pre-crimped tab 62 of the first and second embodiments. The pre-crimped portion 362 is bend inward to the lateral axis of the base member 360 before the base member 360 and the tank member 310 are assembled together. The base member 360 of the third member has the raised portion 68 on the first lateral side 110, similarly to the first embodiment. The tank member 310 and the base member 360 shown in FIG. 8 are assembled together to construct the tank 301 of the third embodiment, as shown in FIG. 9.

Figure 10A:
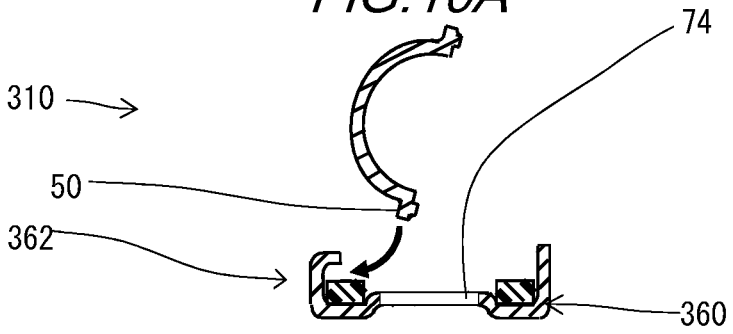
FIGS. 10A to 10D are sectional views showing a manufacturing process for the tank according to the third embodiment.

As follows, a manufacturing process to assemble the tank member 310 and the base member 360 of the third embodiment will be described with reference to FIGS. 10A to 10D. As shown in FIG. 10A, the crimped periphery 50 of the tank member 310 is positioned close to a clearance between the pre-crimped portion 362 of the base member 360 and the seal member 90 adhered to the base member 360.

Figure 10B:
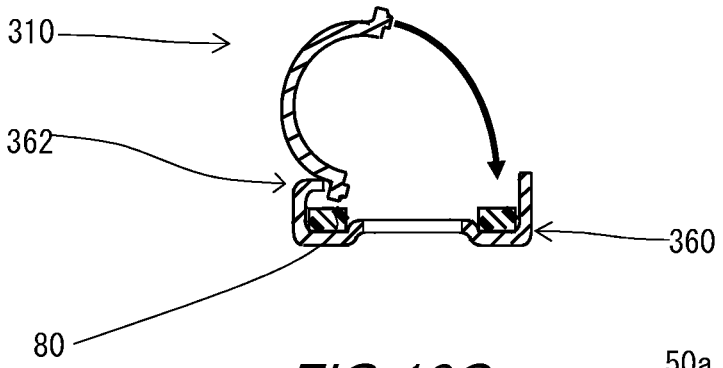
Figure 10C:
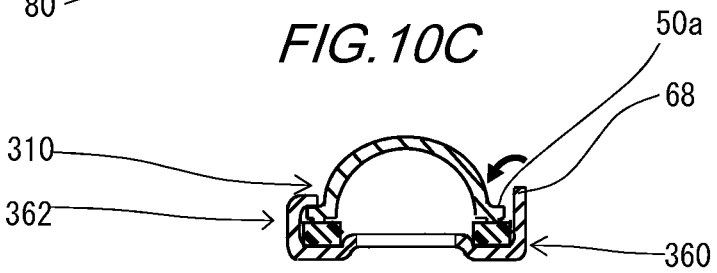
Figure 10D:
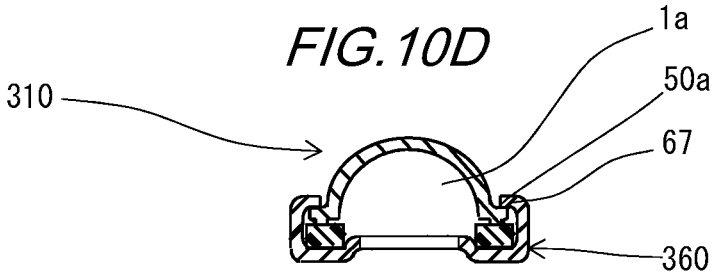

In the state of FIG. 10B, the tank member 310 is rotated around the pre-crimped portion 362, and a lateral end of the crimped periphery 50 is inserted into the clearance between the pre-crimped portion 362 and the seal member 90. Thus, the tank member 310 and the base member 360 are fitted together to be in a state shown in FIG. 100. In the state of FIG. 100, the raised portion 68 of the base member 360 is bent inward to the longitudinal axis, and crimped to the crimped surface 50*a* of the tank member 310 to form the crimped portion 67 shown in FIG. 10D. FIG. 10D is a sectional view taken along the line X-X in FIG. 9.

According to the present embodiment, the base member 360 has the pre-crimped portion 362 on the first lateral side 110. The tank member 310 and the base member 360 are fitted together to define the inner cavity 1*a* therebetween, by inserting the lateral end of the tank member 310 inside the pre-crimped portion 362, and thereafter the tank member 310 is hinged and rotated along the pre-crimped portion 362 relative to the base member 360. The base member 360 is crimped to the tank member 310 on the second lateral side 120.

In the present configuration, similarly to the first and second embodiments, the tank member 310 and the base member 360 need not be crimped on the first lateral side 110.

Other Embodiment

The tank member may include the pre-crimped tabs on the first lateral side, and the base member may include the slot portion on the first lateral side. The tank member may include the pre-crimped tabs on the second lateral side, and the base member may include the slot portion on the second lateral side.

The tank member may include the pre-crimped portion on the first lateral side, and the base member may include the crimped periphery on the first lateral side. The tank member may include the pre-crimped portion on the second lateral side, and the base member may include the crimped periphery on the second lateral side.

The number of pre-crimped tab(s) may be one and may be two or more, and the number of the throughhole(s) may be one and may be two or more, correspondingly to the number of the pre-crimped tab(s).

The curved slope of the tank member may be at least partially in contact with the bent curved surface of the base member.

A seal member may be provided between contact surfaces of the pre-crimped tabs and the first throughholes to enhance sealing property between the tank member and the base member at the engagement portion therebetween.

The tank member 10 and/or the base member 60 may be formed of a resin material such as glass-filled nylon. In this case, the tank member 10 and/or the base member 60 may be formed by injection molding.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A tank for a heat exchanger, the tank comprising:

a tank member having a first slot portion on a first lateral side, the first slot portion defining a first throughhole; and a base member having a pre-crimped tab on the first lateral side, the pre-crimped tab being bent outward from a longitudinal axis, wherein the tank member and the base member are fitted together to define an inner cavity therebetween, the pre-crimped tab is inserted in the first throughhole on the first lateral side, the base member is crimped to the tank member on a second lateral side, the first slot portion has a curved slope adjacent to the first throughhole and located on an outside from the longitudinal axis across the first throughhole, the pre-crimped tab includes a tab end and a bent portion, the tab end extends outward from the bent portion relative to the longitudinal axis the bent portion is bent outward relative to the longitudinal axis to define a bent curved surface, the bent curved surface is curved substantially along the curved slope and is at least partially in contact with the curved slope, and the pre-crimped tab is resiliently in contact with the curved slope to bias the tank member toward the base member.

2. The tank according to claim 1, wherein the base member has a crimped portion on the second lateral side, and the crimped portion is bent inward to the longitudinal axis and crimped to the tank member on the second lateral side.

3. The tank according to claim 1, wherein the base member has a crimped tab on the second lateral side, the tank member has a second slot portion on the second lateral side, the second slot portion having a second throughhole, and the crimped tab is inserted in the second throughhole, bent outward from the longitudinal axis, and crimped to the tank member on the second lateral side.

4. The tank according to claim 1, wherein the tank member and the base member are fitted together by inserting the pre-crimped tab into the first throughhole, and rotating the tank member around the pre-crimped tab, which is inserted into and hinged along the first throughhole, relative to the base member to fit contact surfaces of the tank member and the base member together.

5. The tank according to claim 1, wherein the base member has a bottom portion equipped with a seal member being elastic and substantially in an O-shape, and the tank member has a rib substantially in an O-shape and urged onto the seal member.

6. The tank according to claim 1, wherein the base member has a bottom portion having a plurality of openings each extending through the bottom portion in a thickness direction of the bottom portion.

7. A heat exchanger comprising:

the tank according to claim 1, wherein the base member has a bottom portion having a plurality of openings each extending through the bottom portion in a thickness direction of the bottom portion;

a plurality of tubes coupled with the plurality of openings, respectively; and a plurality of fins alternately stacked with the plurality of tubes.

8. A tank for a heat exchanger according to claim 1, the tank comprising:

a tank member; and a base member having a pre-crimped portion on a first lateral side, wherein the tank member and the base member are fitted together to define an inner cavity therebetween, by inserting a lateral end of the tank member inside the pre-crimped portion, and rotating the tank member relative to the base member along the pre- crimped portion, and the base member is crimped to the tank member on a second lateral side.

9. A tank for a heat exchanger, the tank comprising:

a tank member having one of a pre-crimped tab and a first slot portion on a first lateral side, the pre-crimped tab being bent outward from a longitudinal axis, the first slot portion defining a first throughhole; and a base member having another of the pre-crimped tab and the first slot portion on the first lateral side, wherein the tank member and the base member are fitted together to define an inner cavity therebetween, the pre-crimped tab is inserted in the first throughhole on the first lateral side, and one of the tank member and the base member is crimped to another of the tank member and the base member on a second lateral side, the first slot portion has a curved slope adjacent to the first throughhole and located on an outside from the longitudinal axis across the first throughhole, the pre-crimped tab includes a tab end and a bent portion, the tab end extends outward from the bent portion relative to the longitudinal axis the bent portion is bent outward relative to the longitudinal axis to define a bent curved surface, the bent curved surface is curved substantially along the curved slope and is at least partially in contact with the curved slope, and the pre-crimped tab is resiliently in contact with the curved slope to bias one of the tank member and the base member toward another of the tank member and the base member.

10. The tank according to claim 9, wherein one of the tank member and the base member has a crimped portion on the second lateral side, and the crimped portion is bent inward to the longitudinal axis and crimped to the other of the tank member and the base member on the second lateral side.

11. The tank according to claim 9, wherein one of the tank member and the base member has a crimped tab on the second lateral side, another of the tank member and the base member has a second slot portion on the second lateral side, the second slot portion having a second throughhole, and the crimped tab is inserted in the second throughhole, bent outward from the longitudinal axis, and crimped to the other of the tank member and the base member on the second lateral side.

12. The tank according to claim 9, wherein the tank member and the base member are fitted together by inserting the pre-crimped tab into the first throughhole, and rotating one of the tank member and the base member around the pre-crimped tab, which is inserted into and hinged along the first throughhole, relative to an other of the tank member and the base member to fit contact surfaces of the tank member and the base member together.

13. The tank according to claim 9, wherein the base member has a bottom portion equipped with a seal member being elastic and substantially in an O-shape, and the tank member has a rib substantially in an O-shape and urged onto the seal member.

14. The tank according to claim 9, wherein the base member has a bottom portion having a plurality of openings each extending through the bottom portion in a thickness direction of the bottom portion.

15. A heat exchanger comprising:

the tank according to claim 9, wherein the base member has a bottom portion having a plurality of openings each extending through the bottom portion in a thickness direction of the bottom portion;

a plurality of tubes coupled with the plurality of openings, respectively; and a plurality of fins alternately stacked with the plurality of tubes.

16. A tank for a heat exchanger according to claim 9, the tank comprising:

a tank member; and a base member, wherein one of the tank member and the base member has a pre-crimped portion on a first lateral side, the tank member and the base member are fitted together to define an inner cavity therebetween, by inserting a lateral end of another of the tank member and the base member inside the pre-crimped portion, and rotating one of the tank member and the base member relative to another of the tank member and the base member along the pre-crimped portion, and one of the tank member and the base member is crimped to another of the tank member and the base member on a second lateral side.

* * * * *